United States Patent [19]

Buffington

[11] 3,982,370

[45] Sept. 28, 1976

[54] WALL SYSTEM HAVING DETACHABLE WALL PANELS AND A METHOD OF ASSEMBLING SAME

[75] Inventor: Donald R. Buffington, Atlanta, Ga.

[73] Assignee: Anning-Johnston Company, Orlando, Fla.

[22] Filed: Nov. 30, 1971

[21] Appl. No.: 203,134

[52] U.S. Cl. ..... 52/481; 52/483; 52/511; 52/DIG. 4

[51] Int. Cl.[2] ..... E04B 5/52

[58] Field of Search ..... 52/DIG. 4, 483, 481, 52/511

[56] References Cited

UNITED STATES PATENTS

| | | | |
|---|---|---|---|
| 2,904,364 | 9/1959 | Korodi | 52/DIG. 4 |
| 3,292,328 | 12/1966 | Lewis et al. | 52/DIG. 4 |
| 3,608,266 | 9/1971 | Satkin et al. | 52/481 X |
| 3,609,934 | 10/1971 | O'Carroll | 52/483 X |

*Primary Examiner*—Ernest R. Purser
*Assistant Examiner*—Carl D. Friedman

[57] ABSTRACT

A wall system having removable panels characterized by each panel having a parallel row of magnetic units with a row adjacent each longitudinal edge for holding the panel to magnetically attractive vertical studs of the wall system. In assembling the wall structure, an upper plate or track member and a lower plate or track member are attached to the structure of the building and then the studs are positioned therebetween with equal spacing for the centers of the studs to form a frame. A first panel is mounted on the frame by having an upper edge engaged in the upper track or plate member with the rows of magnetic units disposed over studs and then the panel is moved toward the studs to be held by the magnetic units. The second and subsequent panels are mounted in a similar manner utilizing the previously mounted panel as a guide for positioning during mounting thereof. In narrow panels, the width of the panel is substantially equal to the center distance between the studs and a row of the magnetic units is supplied adjacent each of the longitudinal edges while in larger panels the width of the panel is twice the distance between the centers of the studs and a third row of magnetic units is provided on the longitudinal centerline of the panel to overlay the stud disposed between the pair of studs which the longitudinal edges overlay.

6 Claims, 7 Drawing Figures

Fig. 3
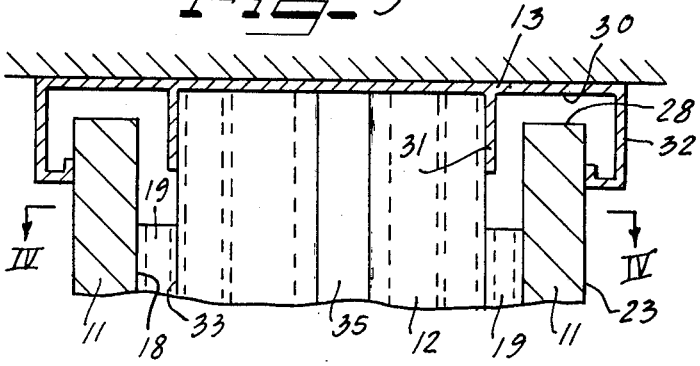
Fig. 4
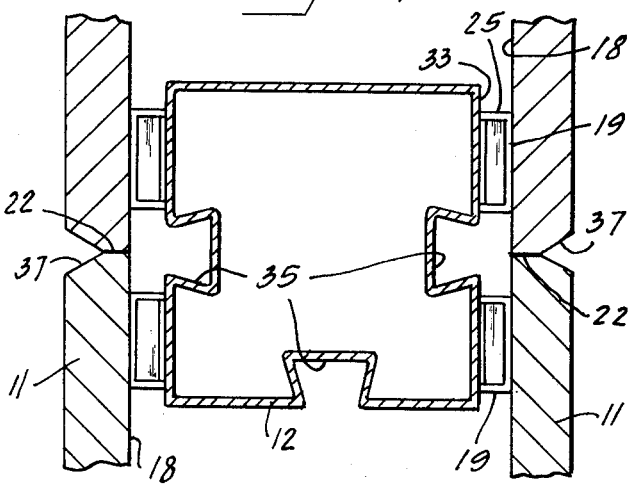
Fig. 6
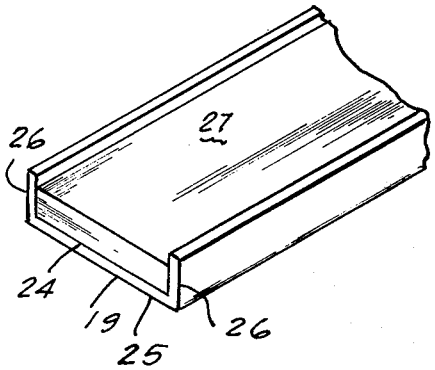
Fig. 5
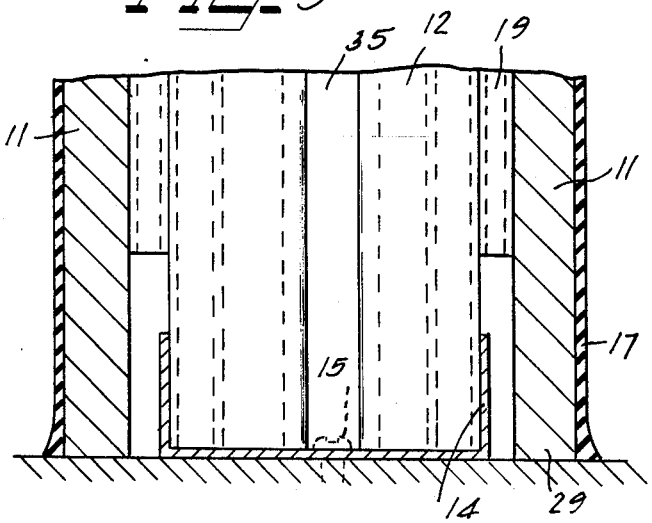
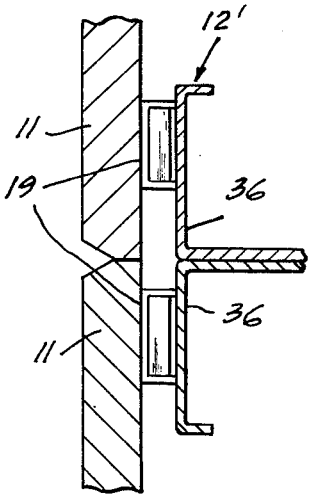
Fig. 7

WALL SYSTEM HAVING DETACHABLE WALL PANELS AND A METHOD OF ASSEMBLING SAME

BACKGROUND OF THE INVENTION

1. Field of the Invention

The present invention is directed to a wall structure and a method of assembling the structure and particularly a wall structure using detachable panels held onto a frame of the wall structure by magnets disposed on the panel.

2. Prior Art

Internal wall structures having a frame formed of plates and studs with detachable panels connected to the frame by mechanical means are well known. However such structures require exact alignment between the panels and the frame for the mechanical fastener to function and thus requires considerable time for erecting.

To enable a rapid assembly and disassembly of the wall structure, several types of wall structures have been proposed which use magnets instead of mechanical fasteners. One type proposes providing magnets on the frame structure such as vertical studs or horizontal support members to hold and attach panels which are provided with a metal coating or are embedded with iron particles. Examples of this type of structure are disclosed in U.S. Pat. No. 2,951,311 and U.S. Pat. No. 3,292,328.

Another type of wall structure, which is disclosed in U.S. Pat. No. 2,760,275, uses floor members, ceiling members and wall panels which have a layer of metal attracted to magnets and separate magnetic anchors which are used to hold the various members in an assembled relationship.

Another type of structure, which is disclosed in U.S. Pat. No. 3,047,931, uses panels which are provided with grooves on their edges which grooves receive a keying device having a magnet to hold the panels against a steel or iron structure. However in this type of structure, a single panel cannot be removed without disturbing adjacent panels.

It has also been suggested to mount ceiling tile (U.S. Pat. No. 3,378,974) and floor tile (U.S. Pat. No. 3,341,996) on a surface having a material attracted by magnets by providing magnets on the tile or magnetic powder embedded in the tile.

It has also been proposed to provide metal clips which are forced into the edges of a panel which strips position a strip of magnets for holding the panel on an iron or steel stud. Such a system is disclosed in U.S. Pat. No. 3,522,923 which also points out an advantage of such a system in allowing removal of any of the paneling without disturbing or destroying the remaining unremoved panels to gain access to the frame of the wall structure and then to replace the panel. However, the use of these clips is limited to panels of material which will readily receive the clip without chipping, splitting or breaking.

SUMMARY OF THE INVENTION

The present invention is directed to a wall structure and a method of assembling the wall structure by using removable panels on which magnetic elements or units are provided to mount the panels on a frame of the wall structure. The magnetic elements are U-shaped channel members having the magnetic material disposed in the channel between the upstanding leg portions and the elements are attached by an adhesive to the back surface of the panel with the magnetic elements being in parallel rows extending along parallel edges of the panel. In one embodiment of the invention, a third row of magnetic elements is provided along a center line of the panel between the two parallel rows disposed at the edges. In erecting or assembling the wall structure, the top and bottom plates of the wall frame are attached to the structure of the building. The studs are then secured between the top and bottom plate members with the studs being substantially equally spaced. The first panel member is accurately assembled on the frame structure by inserting one of the other edges in one of the plate members preferably the upper edge in the upper plate member, to grip the edge. The panel is positioned on the stud by using a plum line so that the parallel rows of magnetic elements overlay the studs adjacent the edges, and then the panel is moved toward the studs so that the magnetic force of the magnetic elements snaps the panel into place and holds it firmly in the assembled position. The remaining panels are assembled in a similar manner using the first assembled panel as a guide.

Accordingly it is an object of the present invention to provide a removable panel for a wall structure which can be easily assembled into the wall structure and can be removed independent of the remaining panels when desired.

Another object of the present invention is to provide a method of assembling or erecting a wall structure utilizing panels held on the frame by magnetic forces.

A still further object of the invention is to provide a removable panel of any type of material which is mounted in a wall structure by magnetic means.

Yet another object of the invention is to provide a removable panel, a wall structure and method of assembling the wall structure which enables assembly with minor variations in the position of the frame structure of the wall structure.

Other objects, features and advantages of the present invention will become manifest to those versed in the art upon making reference to the detailed description and accompanying drawings in which the preferred structural embodiments incorporating the principles of the present invention are shown by illustrative example.

BRIEF DESCRIPTION OF THE DRAWINGS

FIG. 3 is a partial cross section taken along lines III—III of FIG. 1;

FIG. 4 is a partial cross section taken along lines IV—IV of FIG. 3;

FIG. 5 is a partial cross section taken along lines V—V of FIG. 1;

FIG. 6 is a partial enlarged view of a magnetic element unit which is utilized on the panel; and FIG. 7 is a view similar to FIG. 4 illustrating an embodiment of a stud member.

DESCRIPTION OF THE PREFERRED EMBODIMENTS

Figure 1:
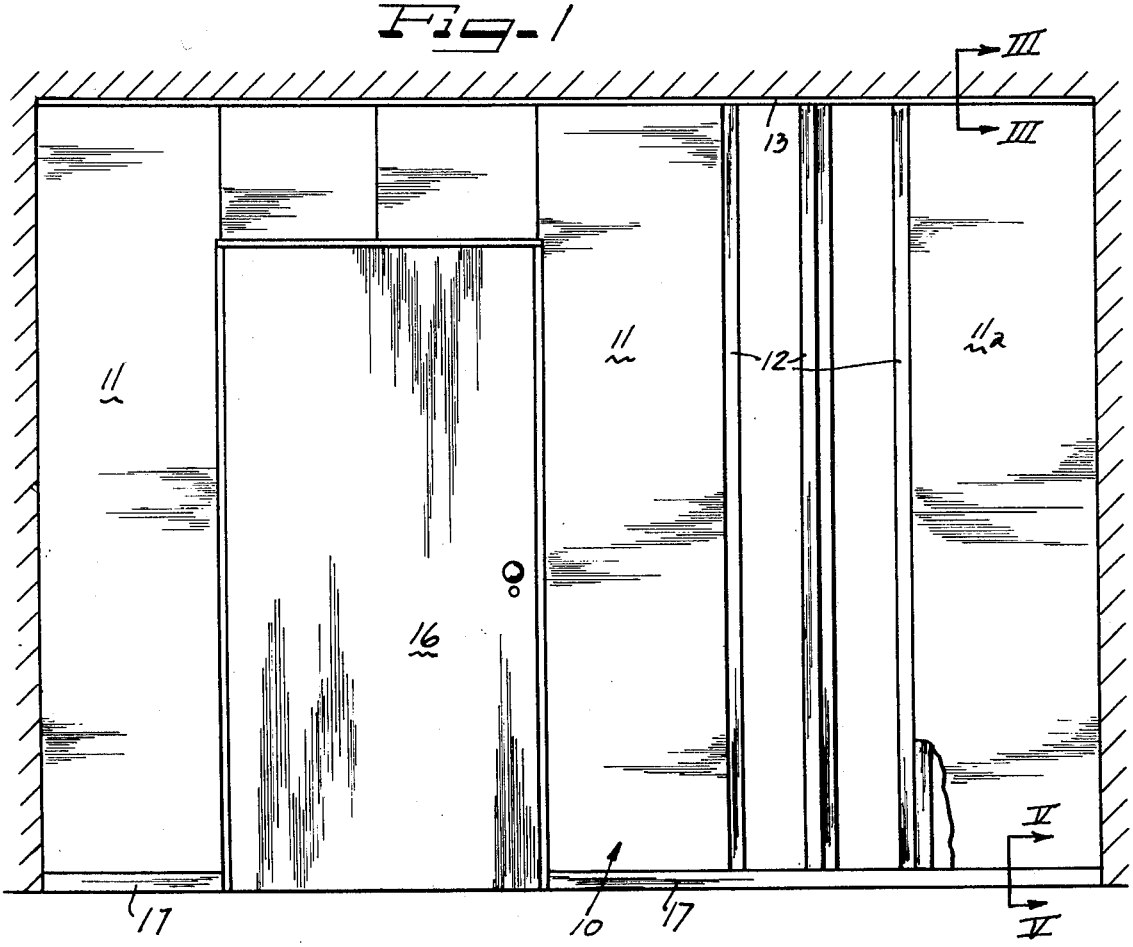
FIG. 1 is a plan view of a wall structure in accordance with the present invention with one of the panels removed for purposes of illustration.

The principles of the present invention can be utilized in a wall structure indicated at 10 and illustrated in FIG. 1. The wall structure 10 has detachable or removable panels 11 which are detachably mounted on a frame formed of vertical studs 12 extending between a horizontal upper track or plate member 13 attached to a ceiling or building structure and a lower or bottom plate or track member 14 (FIG. 5) secured by fasteners 15 to a floor. As illustrated in FIG. 1, the wall structure 10 includes a door assembly 16 which is received in the frame of the wall structure 10. After assembly of the wall structure, a molding strip 17 can be attached to the lower edge of the panel adjacent the floor surface.

Figure 2:
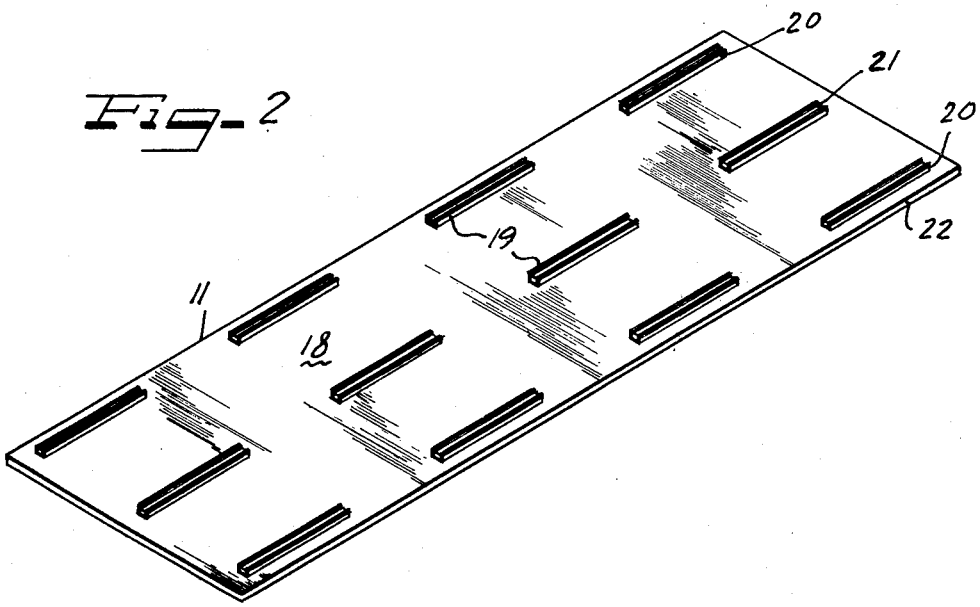
FIG. 2 is a perspective view of a back surface of the panel of the present invention.

As best illustrated in FIG. 2, each of the panel members 11 on a back surface 18 has a plurality of elongated magnetic elements or units 19 which are arranged in parallel rows such as 20 and 21 with a row 20 disposed adjacent each longitudinal edge 22 of the panel and the row 21 being disposed on a longitudinal centerline of the panel 11. In narrow panels, only the two rows 20 are utilized; however in wider panels, the centerline row 21 is also utilized to help support the weight of the panel which may be of any material but is preferably a gypsum board with a desired finish on the front or exposed surface 23.

As illustrated in FIG. 6, each of the magnetic elements or units 19 comprises a channel member 24 having a U-shaped cross section which is made of a low carbon steel and has a bight portion 25 interconnecting a pair of leg portions 26. A permanent magnet 27 is disposed in the channel with an upper edge of each of the leg portions extending above the surface of the magnet 27. The channel member 24 directs the flux lines of the magnet 22 to provide the greatest magnetic attraction at the edges of the leg portions 26. The magnet 27 is preferably a magnet formed of rubber bonded or sintered ferro-magnetic particles such as barium ferrite which magnets are commercially available. An example of a magnetic unit 19 is a channel 24 of a size to receive a magnet 27 which is approximately 12 inches long, one half inch wide and approximately 0.177 inches thick with the leg portion 26 extending not more than 1/64 of an inch above the surface of the magnet 27. The units 19 are adhesively attached to the back surface 18 of the panel with the longitudinal axis of the channels 24 extending in the parallel rows 20 and 21 as illustrated in FIG. 2. Preferably the rows 20 are spaced about ¼ of an inch from the edge 22 and the rows 20 and 21 terminate approximately four inches from both the top edge 28 and bottom edge 29 of the panel 11 to provide clearance for inserting either edge 28 or 29 in a track member such as illustrated in FIGS. 3 and 5.

When the panel 11 is mounted on the frame, the top edge 28 is inserted in a horizontally extending cavity 30 in the upper or top track member 13 which cavity is defined by an inner flange 31 and an outer flange 32. As the magnetic unit 19 holds the panel in a vertical position by the magnetic force acting on the studs 12 which are made of a magnetically attractive material such as steel, the outer flange 32 grips or engages the front or exposed surface 23 adjacent the top edge 28. As illustrated in FIGS. 3 and 4, the edges of leg portions 26 are in contact or engage a surface 33 of the studs 12.

As illustrated in FIG. 4, the studs 12 are a box configuration having integral key slots 35 on at least two sides which are utilized for securing a frame such as a door frame for the door assembly 16. Instead of a box stud 12, a stud 12′ can be fabricated from a pair of channel members 36, 36 which are assembled in a back to back relationship as illustrated in FIG. 7. The studs 12 or 12′ are assembled in the frame or have the upper end received between the flanges 31, 31 of the upper track member 13 and the lower end received in the lower or bottom track member 14 which is a channel member.

The panels 11, as illustrated in FIG. 1, have a width which is twice the distance between the centerlines of adjacent studs 12. If the panel 11 is a narrow panel, the studs can be arranged at a greater width such as on 24 or 30 inch centers with the width of the panel being equal to the distance between the centers.

To assemble the wall, the frame is installed by securing the track 13 on a ceiling or upper ceiling supports of a building structure and by securing the lower track 14 to the floor by appropriate means such as screws or masonary fastening devices 15. Then the studs, whether the box studs 12 or the combined channel studs 12′, are assembled in the two tracks 13 and 14 using a plum line to obtain a vertical and parallel arrangement with the spacing between the centers of the studs of a predetermined distance such as equal to the width of the panel 11. If a door assembly 16 is being provided, an appropriate arrangement of the studs is provided for receiving the door assembly. To mount the panels on the frame formed by the vertical studs and horizontal track, a first panel such as panel 11*a* in FIG. 1, has its upper edge 28 inserted in the cavity 30 and is positioned with its rows 20 of magnetic units 19 positioned over the desired studs with the use of a plum line to obtain the proper orientation. Then the panel is moved toward the studs so that the magnetic attraction provided by the magnet units 19 snap the panel into the proper position and hold it against the studs. A subsequent panel is then installed in the same manner utilizing an edge 22 of the previously installed panel 11*a* as a guide for properly positioning the second panel whose upper edges is inserted in cavity 30 of the track 13 and then the panel is moved to be snapped into engagement and held onto the studs 12 by its magnetic units 19. In a similar manner a third panel is installed using the second panel as a guide.

In those systems or walls in which the width of the panel is such that the weight requires additional holding power, the distance between the studs is one half the width of the panel and the panel has the centerline row 21 of magnetic units 19. These panels are mounted on the frame by the same method with the row 21 overlaying a stud disposed between the studs at the edges 22 of the panel.

An advantage of the present invention is that while the edges 22 of a panel 11 should overlay the center of the studs 12 or 12′, the relative size of the studs are compared to the width of the channels 24 is such that a small amount of mispositioning of the studs can be tolerated. Thus unlike the prior art devices which use hooks received in slots provided in the studs, the method of assembling the wall structure does not require such a high degree of accuracy in the positioning of the studs of the frame.

Another advantage of the wall structure of the present invention is that the magnetic units are bonded adhesively to a back surface of the panels. Thus the panels may be assembled with the edges 22 in tight engagement and does not require cover strips. As illustrated in FIG. 4, the edges 22 have a bevel 37 which coacts with the edge of the adjacent panel to provide a pleasing appearance in the assembled wall structure without requiring cover strips or trim strips.

An advantage of the panels of the present invention is that each panel can be individually removed to gain access to the wall structure or for replacement without disturbing adjacent panels in the stucture. To remove a panel, it is pulled out from the bottom by means of a suction device or jack to decrease the magnetic force of the rows of magnetic unit 19. Then the upper end 28 is withdrawn from the cavity 30 of the track 13. Such a dismantling of one panel does not disturb the adjacent panels since there is no interlocking provided therebetween.

While the method of installation was described with the first panel 11*a* being adjacent one end of the wall structure 10, the initial or first panel can be any one of the panels in the structure with the remaining panels assembled progressively in either direction therefrom.

Although various modifications might be suggested by those versed in the art, it should be understood that I wish to embody within the scope of the patent warranted hereon all such modifications as reasonably and properly come within the scope of my contribution to the art.

I claim:

1. A panel for use in a wall assembly having a plurality of parallel or generally parallel, substantially equally spaced, magnetically attractive metal studs extending from a horizontal or substantially horizontal transverse member to form a frame for receiving a plurality of said panels to form said wall assembly, said panel comprising a panel member of predetermined length and width and having an upper edge and a back surface, at least two generally parallel rows of elongated magnetic units disposed on said back surface of said panel member, the spacing between said rows being substantially equal to the spacing between said metal studs, each of said magnetic units including a U-shaped iron channel member having a bight portion interconnecting a pair of leg portions, said channel members being adhesively secured to said back surface of said panel member with the leg portions extending outwardly therefrom, and each of said magnetic units including a permanent magnet disposed in each of the channels between the leg portions, said upper edge of said panel member being insertable into said transverse member of the frame with said rows of magnetic units positioned over the metal studs to attach and hold said panel by magnetic attraction with the leg portion of each of said magnetic units in contact with a stud.

2. A panel according to claim 1 wherein said panel member has a row of magnetic units adjacent each longitudinal edge running along the width thereof and the width of said panel member is substantially equal to the distance between the centers of two adjacent studs.

3. A panel according to claim 1 wherein the width of said panel member is equal to twice the distance between the centers of a pair of adjacent studs and said panel member has three rows of magnetic units with one row of units located at the longitudinal centerline of panel member and a row adjacent each of the longitudinal edges running along the width of said panel member.

4. A wall assembly comprising a frame and a plurality of removable panels, said frame comprising a plurality of parallel or generally parallel, substantially equally spaced, magnetically attractive metal studs extending from a horizontal or substantially horizontal transverse member to form a frame for said panels, each of said panels comprising a panel member of predetermined length and width, said panel member having an upper edge, a back surface, and longitudinal edges running along the width thereof, at least two generally parallel rows of elongated magnetic units disposed on said back surface of said panel member, the spacing between said rows being substantially equal to the spacing between said metal studs, each of said magnetic units including a U-shaped iron channel member having a bight portion interconnecting a pair of leg portions, said channel members being adhesively secured to said back surface of said panel member with the leg portions extending outwardly therefrom, and each of said magnetic units including a permanent magnet disposed in each of the channels between the leg portions, said upper edge of said panel member being insertable into said transverse member of the frame with said rows of magnetic units positioned over the metal studs to attach and hold said panel by magnetic attraction with the leg portions of each of said magnetic units in contact with a stud, said longitudinal edges of each of said panel members abutting the longitudinal edges of the adjacent panel member after said panels have been attached to said frame.

5. The wall assembly according to claim 4, wherein the spacing between the centers of the metal studs is equal to the width of the panel member and each panel member has a pair of rows of magnetic units with one row disposed adjacent each of said longitudinal edges of said panel member.

6. The wall assembly according to claim 4, wherein the spacing between the centers of the studs is one-half the width of said panel member and wherein said panel member has three parallel rows of magnetic units with one row adjacent each of the longitudinal edges of said panel member and the third row is disposed along the longitudinal centerline of the panel member and parallel to the remaining two rows.

* * * * *